US008505880B2

(12) United States Patent
Langenwalter

(10) Patent No.: US 8,505,880 B2
(45) Date of Patent: Aug. 13, 2013

(54) FENCE RAIL SUPPORT SYSTEM

(75) Inventor: Duane Langenwalter, Newtown, CT (US)

(73) Assignee: Origin Point Brands, LLC, N. Charleston, SC (US)

( * ) Notice: Subject to any disclaimer, the term of this patent is extended or adjusted under 35 U.S.C. 154(b) by 122 days.

(21) Appl. No.: 12/805,260

(22) Filed: Jul. 21, 2010

(65) Prior Publication Data

US 2012/0018692 A1 Jan. 26, 2012

(51) Int. Cl.
*E04H 17/00* (2006.01)

(52) U.S. Cl.
USPC ..... 256/65.12; 256/65.08; 256/65.14

(58) Field of Classification Search
USPC ..... 256/19, 59, 65.02, 65.03, 65.08, 256/65.11, 65.12, 65.14; 403/247, 252, 255, 403/256, 263
See application file for complete search history.

(56) References Cited

U.S. PATENT DOCUMENTS

| | | | |
|---|---|---|---|
| 313,825 | A | 3/1885 | Jones |
| 502,840 | A | 8/1893 | Ward |
| 803,741 | A | 11/1905 | Carlson |
| 895,297 | A | 8/1908 | Peter |
| 1,630,492 | A | 5/1927 | Kusterle |
| 1,757,686 | A | 5/1930 | Rosenbaum |
| 1,796,175 | A | 3/1931 | Winston |
| 2,218,953 | A | 10/1940 | Gustafson |
| 2,218,954 | A | 10/1940 | Gustafson |
| 2,327,311 | A | 8/1943 | Lundy |
| 2,427,723 | A | 9/1947 | Hawkins et al. |
| 2,482,592 | A | 9/1949 | Miller et al. |
| 2,558,142 | A | 6/1951 | Lapp et al. |
| 2,563,529 | A | 8/1951 | Hawkins |
| 2,563,530 | A | 8/1951 | Hawkins |
| 2,576,427 | A | 11/1951 | Tomb |
| 2,590,929 | A | 4/1952 | Bush |
| 2,654,579 | A | 10/1953 | Cremens |
| 2,655,345 | A | 10/1953 | Lindman |
| 2,687,283 | A | 8/1954 | Enghauser |
| 2,715,513 | A | 8/1955 | Kools |
| 2,840,349 | A | 6/1958 | Raymond |
| 2,855,227 | A | 10/1958 | Bottom |
| 2,909,361 | A | 10/1959 | Dotson |
| 2,932,488 | A | 4/1960 | Dotson |
| 3,033,532 | A | 5/1962 | McFall |
| 3,067,985 | A | 12/1962 | Cusack |
| 3,083,951 | A | 4/1963 | Huret |
| 3,113,760 | A | 12/1963 | Huret et al. |
| 3,202,401 | A | 8/1965 | Bastia |

(Continued)

FOREIGN PATENT DOCUMENTS

| | | |
|---|---|---|
| GB | 2093513 | 9/1982 |
| JP | 353-69439 | 6/1978 |
| WO | WO 00/04257 | 1/2000 |

*Primary Examiner* — Daniel P. Stodola
*Assistant Examiner* — Jonathan Masinick
(74) *Attorney, Agent, or Firm* — Nexsen Pruet, LLC; Timothy D. St. Clair

(57) ABSTRACT

Apparatus and method of assembling a fence system. A fence post comprises an inner structural post and an outer post. The inner structural post includes a base flange for attaching the inner structural post to a surface. A lower insert block is inserted over the inner structural post and in contact with the base flange. The outer post comprises upper and lower apertures. Horizontal rail supports are inserted through the upper and lower apertures. The horizontal rail supports are locked in place by locking devices. Horizontal rails are inserted over the horizontal rail supports to create a fence system.

19 Claims, 18 Drawing Sheets

(56) References Cited

U.S. PATENT DOCUMENTS

| | | | | |
|---|---|---|---|---|
| 3,204,898 | A | 9/1965 | Manning | |
| 3,240,297 | A | 3/1966 | Desy | |
| 3,244,406 | A | 4/1966 | Garofola | |
| 3,258,251 | A | 6/1966 | Culter | |
| 3,278,209 | A | 10/1966 | Winikoff | |
| 3,306,586 | A | 2/1967 | Green | |
| 3,315,943 | A | 4/1967 | Van Den Broek | |
| 3,343,811 | A | 9/1967 | Kusel et al. | |
| 3,385,567 | A | 5/1968 | Case et al. | |
| 3,414,236 | A | 12/1968 | Siegal | |
| 3,420,013 | A | 1/1969 | Alvarado | |
| 3,506,999 | A | 4/1970 | Neher | |
| 3,529,808 | A | 9/1970 | Siebers | |
| 3,596,880 | A | 8/1971 | Greenberg | |
| 3,648,982 | A | 3/1972 | Sabel et al. | |
| 3,704,005 | A | 11/1972 | Kusel | |
| 3,707,276 | A | 12/1972 | Francis et al. | |
| 3,854,192 | A | 12/1974 | O'Konski | |
| 3,858,850 | A | 1/1975 | Maxcy et al. | |
| 3,942,763 | A | 3/1976 | Helterbrand et al. | |
| 3,960,367 | A | 6/1976 | Rogers | |
| 4,047,702 | A * | 9/1977 | Cernia et al. | 256/13.1 |
| 4,238,117 | A | 12/1980 | Newman | |
| 4,272,061 | A | 6/1981 | Suckno | |
| 4,360,285 | A | 11/1982 | Magness | |
| 4,403,767 | A | 9/1983 | Basey | |
| 4,421,302 | A | 12/1983 | Grimm et al. | |
| 4,533,121 | A | 8/1985 | Basey | |
| 4,690,440 | A | 9/1987 | Rogers | |
| 4,723,760 | A | 2/1988 | O'Sullivan | |
| 4,786,203 | A | 11/1988 | Conner et al. | |
| 4,871,203 | A | 10/1989 | Rogers | |
| 4,883,256 | A | 11/1989 | Hebda | |
| 4,886,245 | A | 12/1989 | Manzo | |
| 4,898,365 | A | 2/1990 | Conner et al. | |
| 4,917,284 | A | 4/1990 | Candiracci | |
| 4,928,930 | A | 5/1990 | Chung | |
| 4,972,642 | A | 11/1990 | Strobl, Jr. | |
| 4,982,933 | A | 1/1991 | Schultz | |
| 5,029,820 | A | 7/1991 | Katz | |
| 5,056,283 | A | 10/1991 | Sapinski | |
| 5,136,813 | A | 8/1992 | Gibbs et al. | |
| 5,167,049 | A | 12/1992 | Gibbs | |
| 5,190,268 | A | 3/1993 | Espinueva | |
| 5,200,240 | A | 4/1993 | Baker | |
| 5,255,897 | A | 10/1993 | Pepper | |
| 5,340,087 | A | 8/1994 | Turner | |
| 5,372,354 | A | 12/1994 | Cacicedo | |
| 5,383,739 | A | 1/1995 | Haglund | |
| 5,419,538 | A | 5/1995 | Nicholas et al. | |
| 5,437,433 | A | 8/1995 | Rezek | |
| 5,443,244 | A | 8/1995 | Gibbs | |
| 5,454,548 | A | 10/1995 | Moore | |
| 5,547,169 | A | 8/1996 | Russell | |
| 5,556,079 | A | 9/1996 | West | |
| 5,649,688 | A | 7/1997 | Baker | |
| 5,660,378 | A | 8/1997 | Schall | |
| 5,820,111 | A | 10/1998 | Ross | |
| 5,873,564 | A | 2/1999 | Bisch | |
| 5,873,671 | A | 2/1999 | West | |
| 5,882,001 | A | 3/1999 | Reinbold | |
| 5,896,721 | A | 4/1999 | Sugiyama | |
| 5,957,424 | A | 9/1999 | Krinner | |
| 5,971,365 | A | 10/1999 | Pigott et al. | |
| 5,984,587 | A | 11/1999 | Odle | |
| 6,029,954 | A | 2/2000 | Murdaca | |
| 6,126,145 | A | 10/2000 | Mohr | |
| 6,176,043 | B1 | 1/2001 | Gibbs | |
| 6,176,053 | B1 | 1/2001 | St. Germain | |
| 6,189,277 | B1 | 2/2001 | Boscamp | |
| 6,199,336 | B1 | 3/2001 | Poliquin | |
| 6,254,064 | B1 | 7/2001 | Gibbs | |
| 6,299,143 | B1 | 10/2001 | Valentine | |
| 6,305,670 | B1 | 10/2001 | Ward et al. | |
| 6,308,937 | B1 | 10/2001 | Pettit | |
| 6,311,957 | B1 | 11/2001 | Driscoll et al. | |
| 6,341,764 | B1 | 1/2002 | Conner | |
| 6,345,809 | B1 * | 2/2002 | Bebendorf | 256/24 |
| 6,375,166 | B1 | 4/2002 | Schall et al. | |
| 6,460,829 | B1 | 10/2002 | Forbis et al. | |
| D465,856 | S | 11/2002 | Givens et al. | |
| 6,612,087 | B2 | 9/2003 | diGirolamo et al. | |
| 6,631,887 | B1 | 10/2003 | Walmsley | |
| 6,648,304 | B1 | 11/2003 | Zhu | |
| 6,682,056 | B1 | 1/2004 | West | |
| 6,698,726 | B2 | 3/2004 | Platt | |
| 6,739,583 | B2 | 5/2004 | Ryon | |
| 6,752,385 | B2 | 6/2004 | Zen et al. | |
| 6,752,386 | B1 | 6/2004 | Bundy | |
| D495,434 | S | 8/2004 | Cooper | |
| 6,802,496 | B1 | 10/2004 | Preta | |
| 6,811,145 | B2 | 11/2004 | Gibbs et al. | |
| 6,824,123 | B2 | 11/2004 | Larsen et al. | |
| 6,874,767 | B1 | 4/2005 | Gibbs | |
| 6,883,786 | B2 | 4/2005 | Bebendorf | |
| 6,889,960 | B1 | 5/2005 | Jones | |
| 6,969,051 | B1 | 11/2005 | Gibbs | |
| 7,021,607 | B1 | 4/2006 | Alexander | |
| 7,025,335 | B2 | 4/2006 | Zhu | |
| 7,071,439 | B2 | 7/2006 | Gibbs et al. | |
| 7,077,386 | B1 | 7/2006 | Gray, Jr. et al. | |
| 7,086,642 | B1 | 8/2006 | O'Brien | |
| 7,090,202 | B1 | 8/2006 | O'Brien | |
| 7,100,904 | B2 | 9/2006 | Kim | |
| 7,121,530 | B1 | 10/2006 | Preta | |
| 7,134,646 | B1 | 11/2006 | Brooks et al. | |
| D534,792 | S | 1/2007 | Cooper | |
| 7,159,853 | B2 | 1/2007 | Gibbs et al. | |
| 7,178,791 | B1 | 2/2007 | Gray, Jr. et al. | |
| 7,188,826 | B1 | 3/2007 | Gibbs | |
| 7,232,114 | B2 * | 6/2007 | Platt | 256/65.04 |
| 7,243,473 | B2 | 7/2007 | Terrels | |
| 7,306,203 | B2 | 12/2007 | Platt | |
| 7,325,787 | B1 | 2/2008 | Gibbs | |
| 7,341,242 | B2 | 3/2008 | Bertato | |
| 7,347,412 | B1 | 3/2008 | Zhu | |
| 7,360,754 | B2 | 4/2008 | Robbins | |
| 7,384,025 | B2 | 6/2008 | Lo | |
| D572,374 | S | 7/2008 | Gibbs | |
| 7,396,002 | B1 | 7/2008 | Gibbs | |
| 7,407,152 | B2 | 8/2008 | Platt | |
| 7,434,789 | B2 | 10/2008 | Crumrine | |
| 7,445,196 | B2 | 11/2008 | Cantley et al. | |
| 7,455,282 | B2 | 11/2008 | Platt | |
| 7,475,868 | B1 | 1/2009 | Gibbs | |
| 7,475,870 | B2 | 1/2009 | Platt | |
| 7,478,799 | B2 | 1/2009 | Viviano | |
| 7,503,551 | B2 | 3/2009 | Auret | |
| 7,530,550 | B2 * | 5/2009 | Fattori | 256/65.05 |
| 7,621,510 | B2 | 11/2009 | Gibbs et al. | |
| 7,635,115 | B2 | 12/2009 | Lehmann | |
| 7,661,656 | B1 | 2/2010 | Gibbs et al. | |
| 7,677,535 | B1 | 3/2010 | Lo | |
| 7,762,533 | B2 | 7/2010 | DeRogatis et al. | |
| 7,819,390 | B2 | 10/2010 | Godwin et al. | |
| 7,896,318 | B1 | 3/2011 | Gibbs et al. | |
| 7,971,412 | B1 | 7/2011 | Lim | |
| 7,992,362 | B2 | 8/2011 | Petta | |
| 2003/0146426 | A1 | 8/2003 | Ray et al. | |
| 2003/0151039 | A1 | 8/2003 | Zen et al. | |
| 2005/0205854 | A1 | 9/2005 | Gibbs et al. | |
| 2006/0169965 | A1 | 8/2006 | Paskar | |
| 2009/0065755 | A1 | 3/2009 | Sherstad | |
| 2009/0238640 | A1 | 9/2009 | Godwin et al. | |
| 2010/0155683 | A1 | 6/2010 | Payne et al. | |
| 2010/0200827 | A1 | 8/2010 | Duffy et al. | |
| 2010/0237308 | A1 | 9/2010 | Lo | |
| 2010/0252793 | A1 | 10/2010 | Ash | |
| 2010/0276653 | A1 | 11/2010 | Gibbs | |
| 2010/0288988 | A2 | 11/2010 | Gibbs et al. | |
| 2011/0001105 | A1 | 1/2011 | Lo | |

* cited by examiner

FENCE RAIL SUPPORT SYSTEM

BACKGROUND OF THE INVENTION

The present invention relates to a fence system wherein a horizontal fence rail is attached to a vertical fence post via a horizontal rail support.

1. Field of the Invention

The present invention relates generally to a fence system and a method of assembling a fence system, and, more particularly, to such a fence system that includes horizontal rail supports inserted into a fence post for supporting horizontal rails. The fence post is configured so it can be used for either straight run fence sections or corners.

2. Description of the Related Art

Fence systems are known in the industry. Known fence systems are difficult to assemble, except by skilled workers, or else are aesthetically unpleasing. In many systems, a horizontal rail must be attached to a fence post by a user in a process which requires the user to take measurements to attach brackets, resulting in a fence system with exposed and unsightly brackets. Another system, wherein inserts rather than exposed brackets are utilized as a means of connection, the connection is proportioned so as to allow expansion and contraction of the rail, resulting in instability.

SUMMARY OF THE INVENTION

The present invention provides a fence post that may include apertures so that a fence system may be assembled easily, and be aesthetically pleasing, with horizontal rails held in place by horizontal rail supports inserted into the fence posts, rather than through the use of brackets.

The horizontal rail supports inserted into the fence post preferably are locked in place with locking devices for additional stability. These locking devices may be wedges.

The horizontal rail supports which are inserted into the fence post may include projecting tabs received in concave slots in the wedges.

The present invention further provides a method of assembling a fence wherein horizontal rails are held in place by horizontal rail supports inserted into apertures in fence posts.

The method may include a locking step by inserting wedges between the horizontal rail supports and the apertures in the fence post.

The horizontal rail supports preferably are inserted from an interior of the fence post.

Both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The objects and advantages of the present invention will be apparent from the detailed explanation of the preferred embodiments of the invention in connection with the accompanying drawings, wherein.

DETAILED DESCRIPTION OF THE INVENTION

Figure 1:
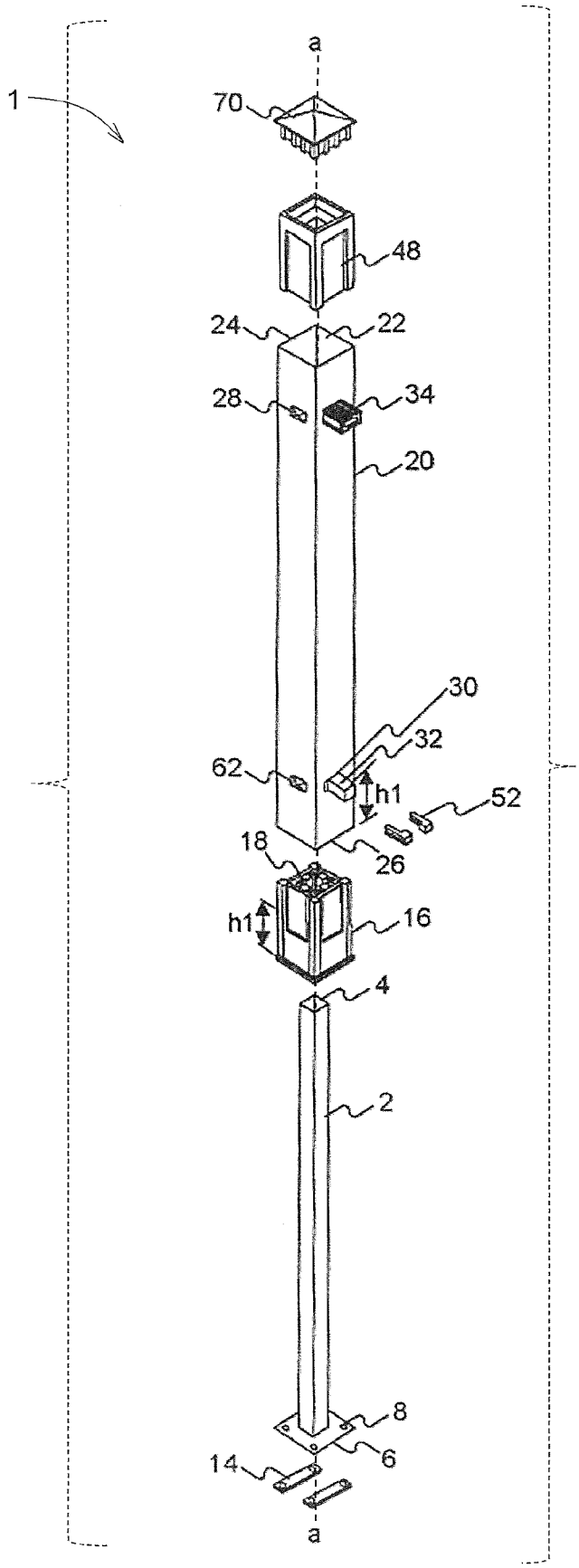
FIG. 1 is an exploded front elevational view of a fence post of a fence system in accordance with the present invention.
Figure 2:
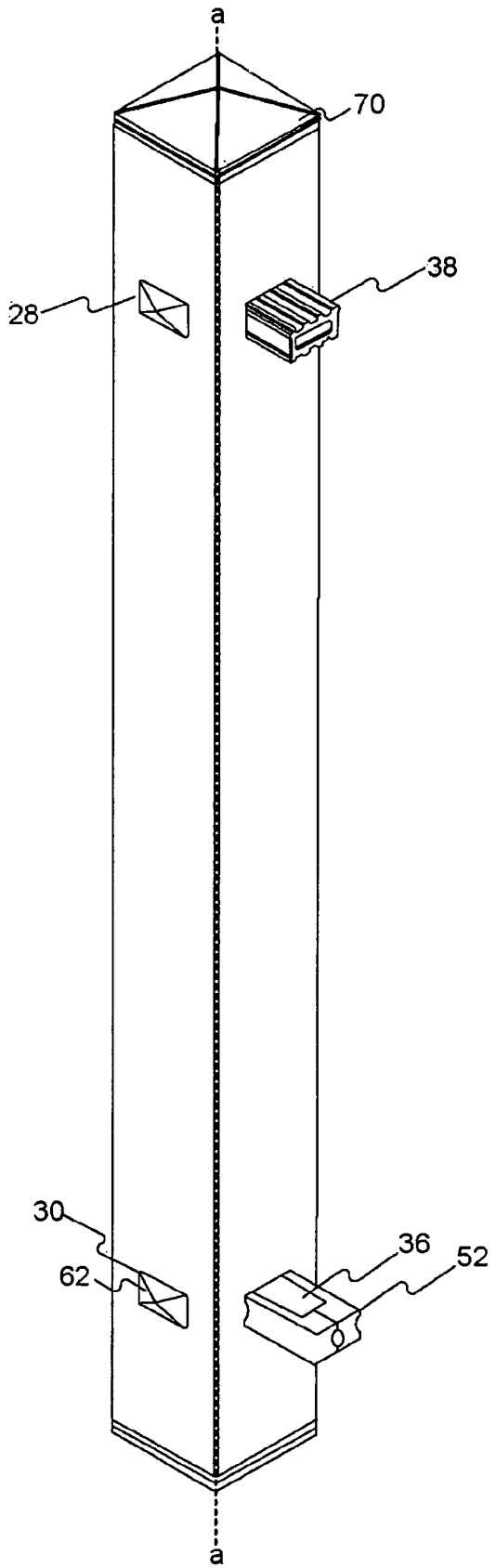
FIG. 2 is a front elevational view of the fence post of FIG. 1, showing various components thereof.

Referring to the drawings, and in particular to FIGS. 1 and 2, a fence post in accordance with the present invention is referred to generally by reference numeral 1. The fence post 1 comprises an inner structural vertical post 2. The inner structural vertical post 2 defines a vertical axis a-a, and includes an upper distal end 4 and a lower distal end 6. The lower distal end 6 comprises a base flange 8 through which the inner structural vertical post 2 is configured to be attached to a generally horizontal surface, e.g. a deck or patio.

The fence post 1 can be secured to the surface by the base flange 8. In the preferred embodiment, carriage bolts and lag bolts insert through the base flange 8 and into the surface to connect the inner structural vertical post 2 to reinforcements 14. An alternative embodiment includes a bolt-on addition that may be used for side mounting and mounting to stringers on stairs.

Figure 3:
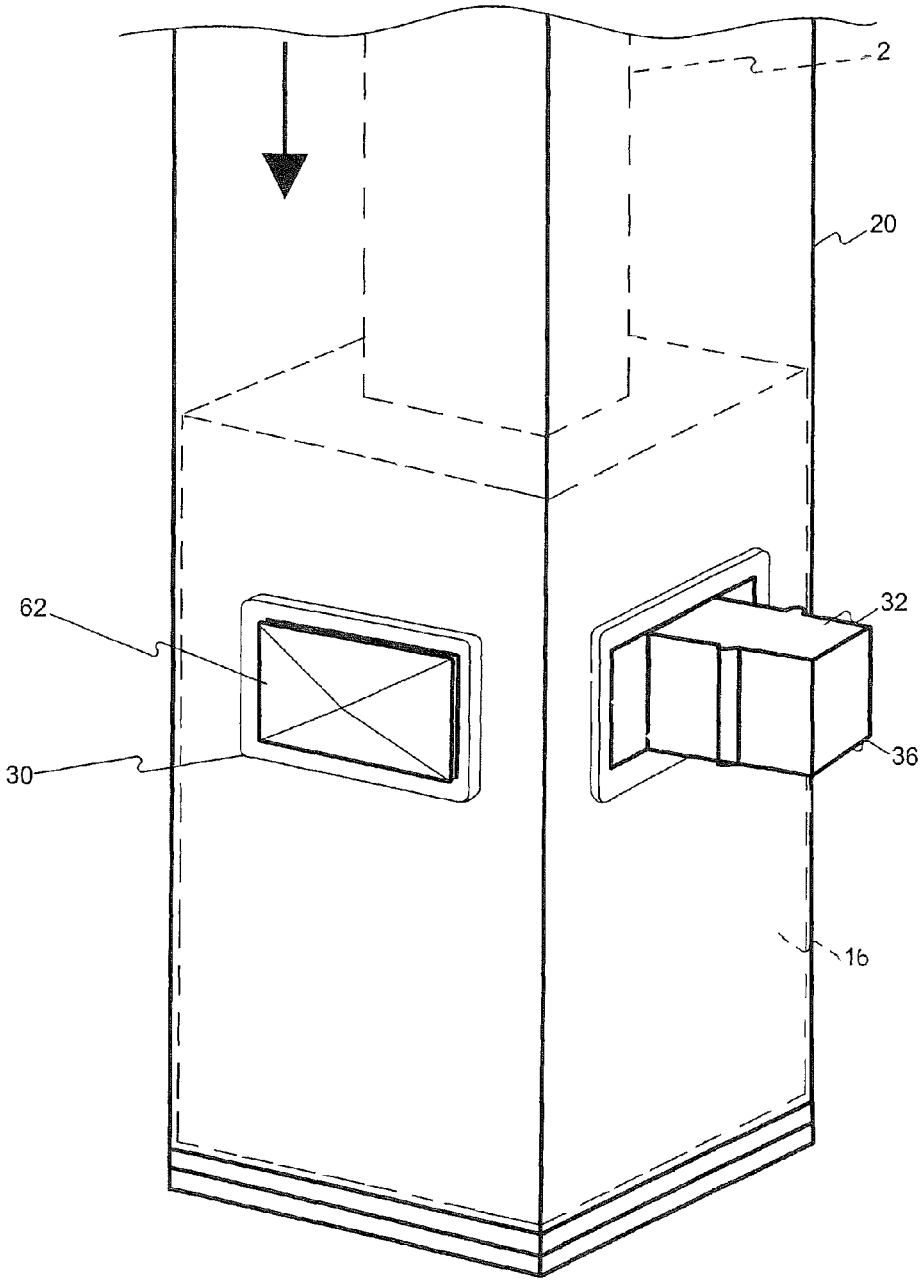
FIG. 3 is an perspective view of an interior of a bottom portion of the fence post of FIG. 1.

A lower insert block 16, as shown in FIGS. 1 and 3, having a coaxial bore 18 slides over the inner structural vertical post 2 and rests on top of the base flange 8.

An outer post 20 comprises a coaxial bore 22, an upper distal opening 24, and a lower distal opening 26. The upper and lower distal openings 24, 26 are dimensioned to slide over the inner structural vertical post 2 and the lower insert block 16. The outer post 20 also includes an upper aperture 28 proximate the upper distal opening 24 and a lower aperture 30. The lower aperture 30 is positioned at a selected height h1 above the lower distal opening 26, and the selected height h1 is substantially equal to the height of the lower insert block 16. Preferably, the outer post 20 is composed of galvanized and powder coated steel, however, other material may be utilized depending on an intended use of the fence and characteristics required for the fence post 1.

Figure 4:
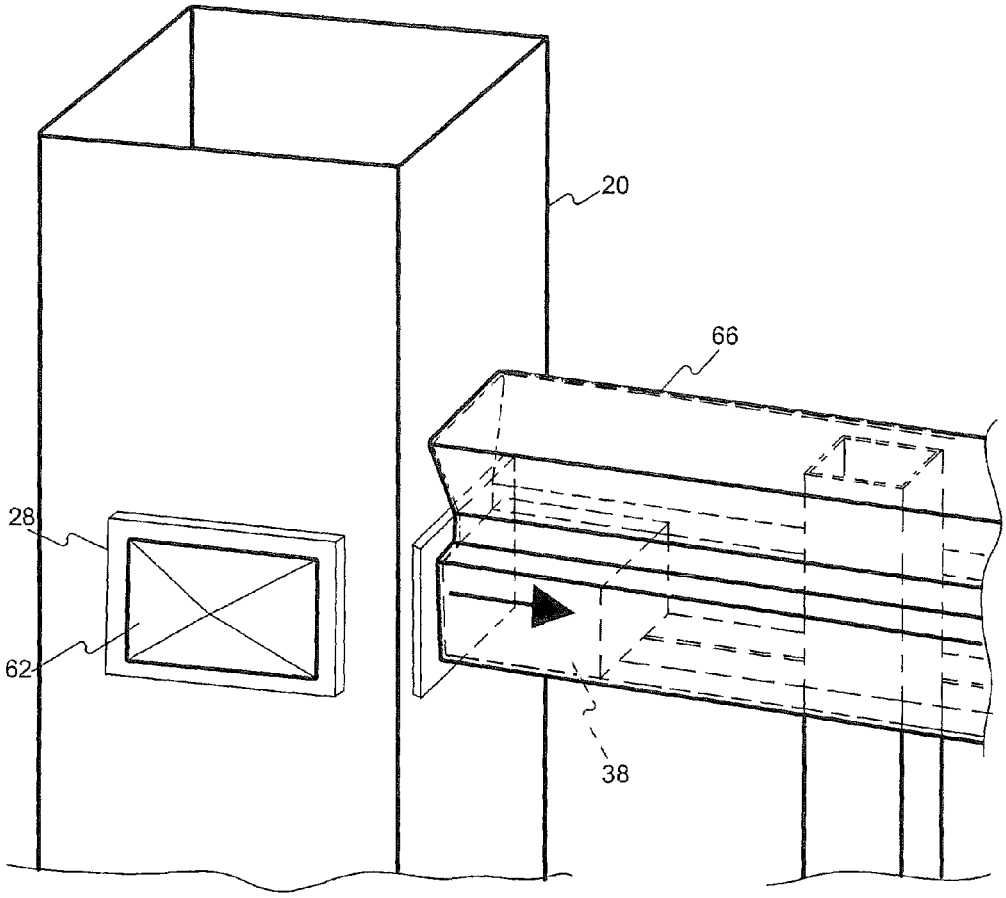
FIG. 4 is an perspective view of the exterior of the top of the fence post depicting installation of a lower horizontal rail support in accordance with the invention.

As broadly depicted in FIGS. 2, 3 and 4, a first horizontal rail support 32 is inserted in to a lower aperture 30 at a direction substantially normal to the vertical axis a-a. A second horizontal rail support 34 is inserted into an upper aperture 28 at a direction substantially normal to the vertical axis a-a. A first portion 36, 38 of the first and second horizontal rail supports 32, 34 extend from the exterior 40 of the outer post 20 and a second portion 42, 44 of the first and second horizontal rail supports, 32, 34 extend into the interior 46 of the outer post 20.

Figure 6:
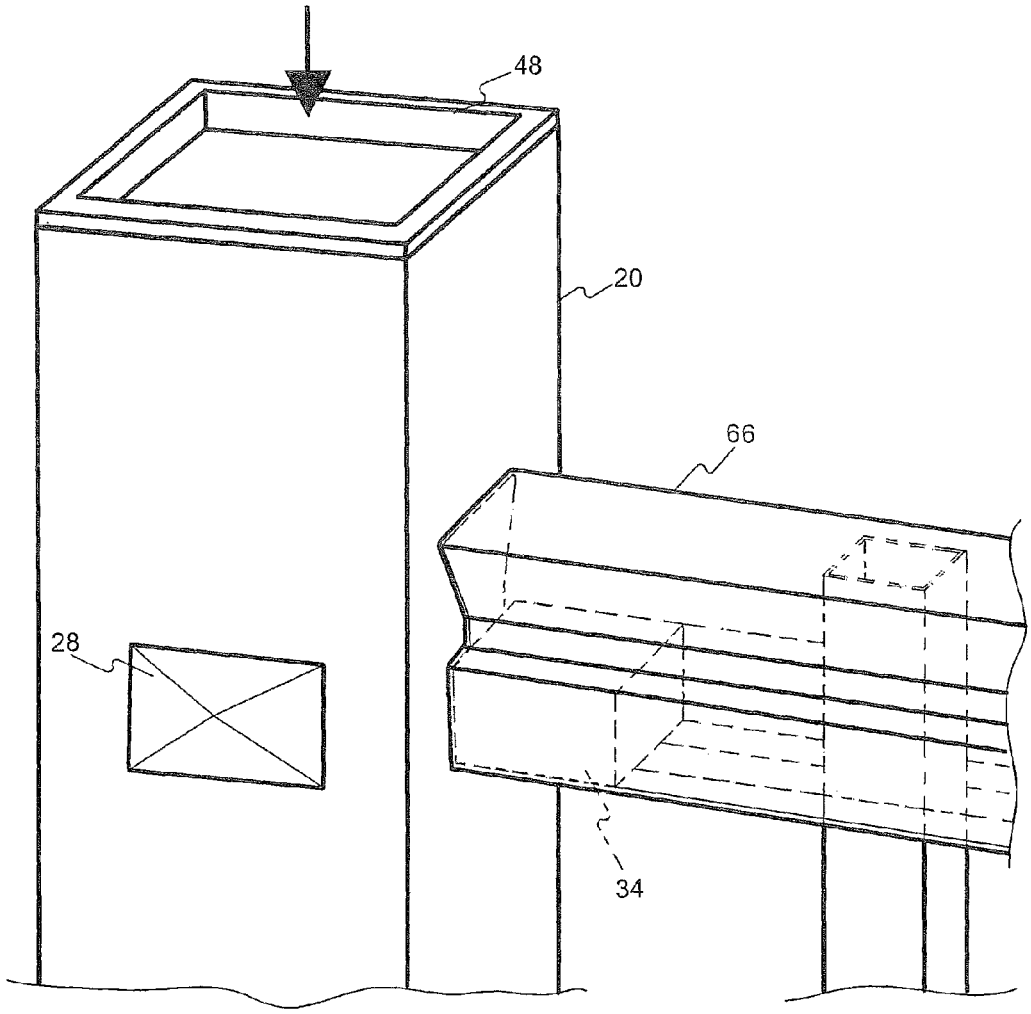
FIG. 6 is an perspective view of the exterior of a top portion of the fence post, depicting installation of an upper insert block.
Figure 7:
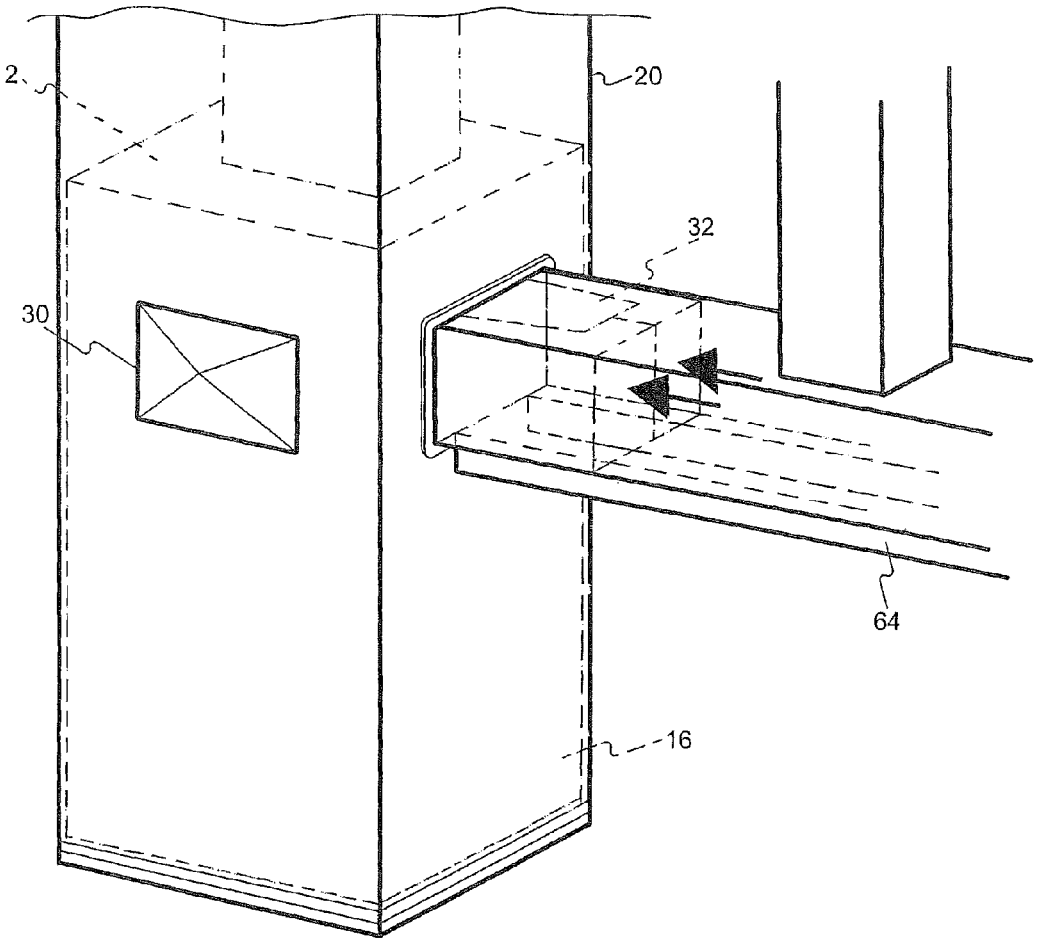
FIG. 7 is an perspective view of the exterior of the bottom of the fence post depicting installation and locking in place of a lower rail support wedge.

As broadly depicted in FIG. 6, an upper insert block 48 applies downward compressive pressure to the second portion 44 of the second horizontal rail support 34. As broadly depicted in FIG. 3, the lower insert block 16 applies upward compressive pressure to the second portion 42 of the first horizontal rail support 32. In a preferred embodiment, both the first and second horizontal rail supports 32, 34 comprise flanges.

Figure 8A:
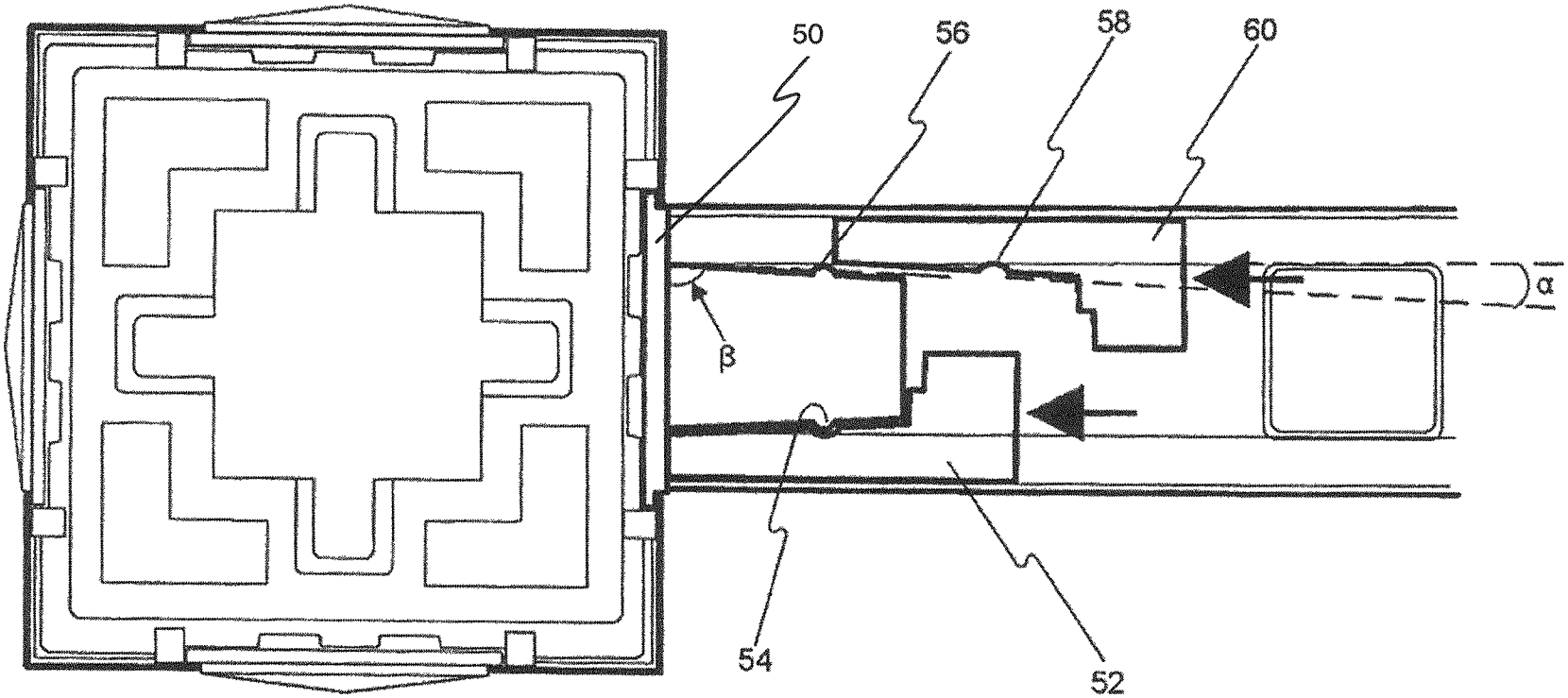
FIG. 8*a* is a breakaway view of the bottom of the fence post including the lower horizontal rail, the horizontal rail support, the lower insert block, and the lower rail support wedge.
Figure 8B:
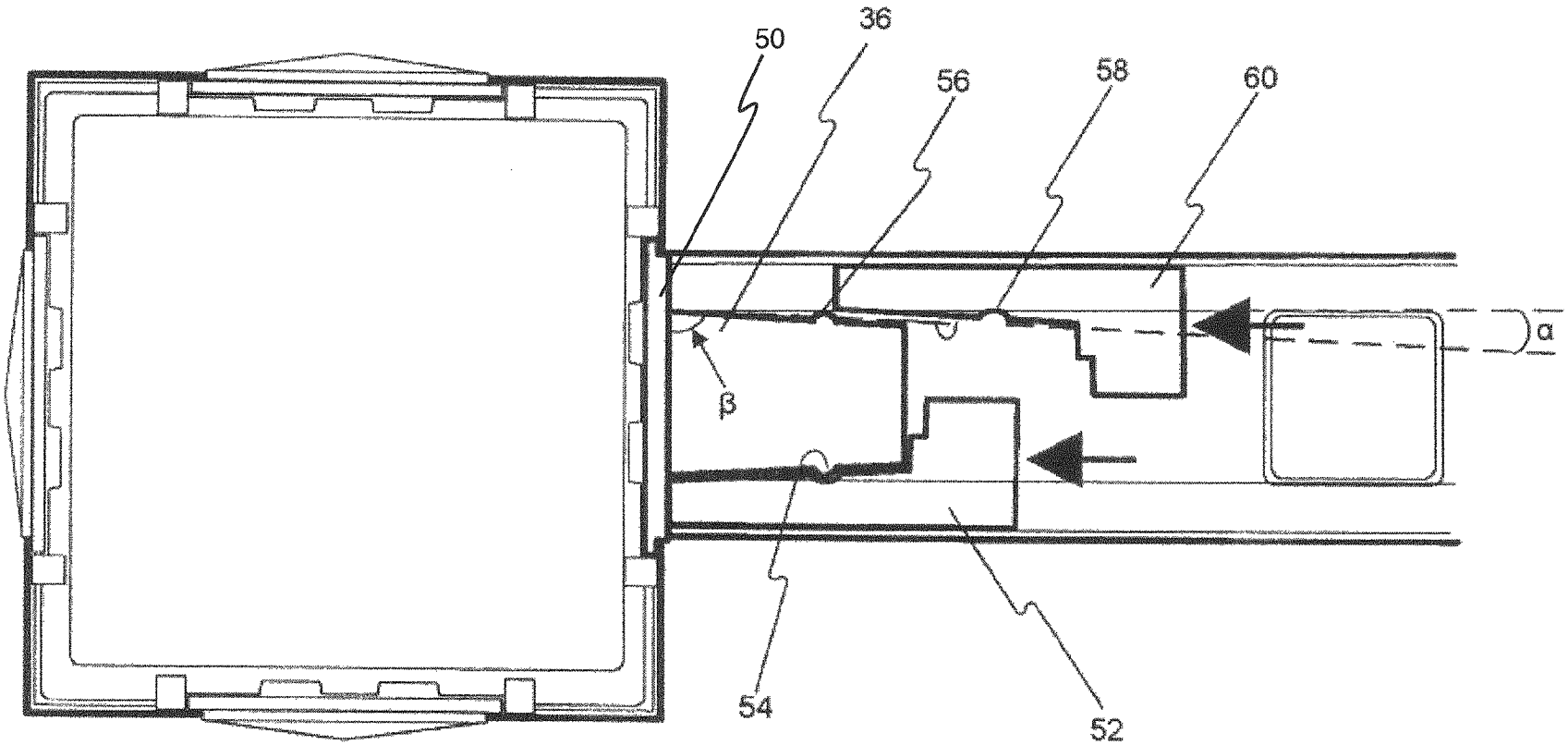
FIG. 8*b* is a breakaway view of the fence post including a horizontal rail, a horizontal rail support, and rail support wedges.

As broadly depicted in FIGS. 8*a* and 8*b*, the first and second horizontal rail supports 32, 34 are further locked in place with upper and lower locking devices 50 inserted through the respective upper and lower apertures 28, 30. As broadly embodied herein, these locking devices 50 preferably comprise wedges 52 configured to fit on sides of the respective horizontal rail supports 32, 34. Each wedge 52 has an inner sloped surface, having an angle α, in contact with a corresponding sloped outer surface of the respective horizontal rail support 32, 34, having an angle β, wherein angles α and β are substantially supplementary. Preferably, the horizontal rail supports 32, 34 include projecting tabs 54, 56 and the inner surfaces of the wedges 52 include concave slots 58 configured to receive the projecting tabs 53, 54. Preferably, the wedges 52 further comprise stops 60, which when engaged are in contact with the respective horizontal rail supports 32, 34.

Preferably, as shown in FIG. 2, decorative caps 62 are inserted into any lower apertures 30 and upper apertures 28 in which no horizontal rail supports are inserted.

Figure 9:
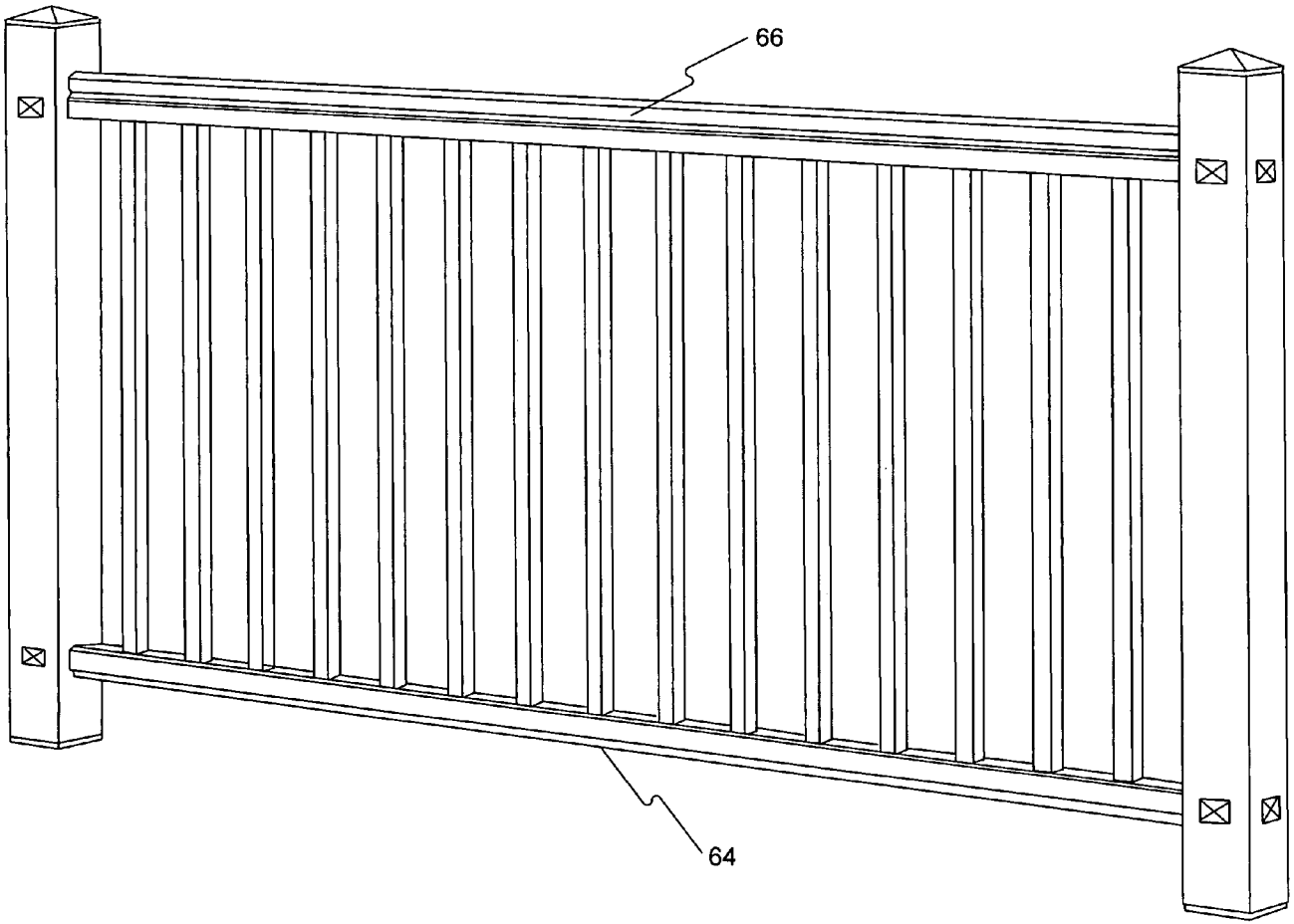
FIG. 9 is a front elevational view of the assembled fence system of the present invention.

As illustrated in FIG. 9, two fence posts can be connected to each other with a lower horizontal rail 64 and upper horizontal rail 66 to create a fence system 68. The lower and upper horizontal rails 64, 66 have open ends which are inserted over each fence post's upper and lower horizontal rail supports 32, 34, respectively, as shown in FIGS. 3-8. In a preferred embodiment, the locking device 50, preferably the wedge 52, is in contact with the horizontal rail supports 32, 34, thus holding the horizontal rails 64, 66 in place. In another embodiment, the lower and upper horizontal rails 64, 66 include an opening for the insertion of the locking device 50.

Figure 10A:
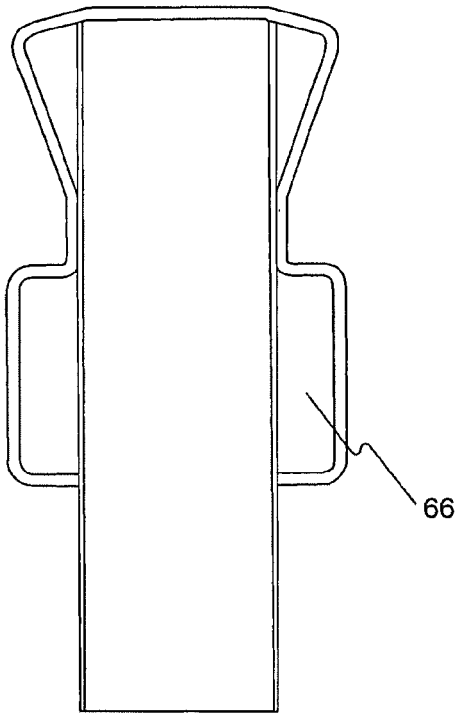
FIGS. 10*a*-10*e* are perspective views of an upper horizontal rail of the fence system of FIG. 9 with various configurations of accent rails.
Figure 10B:
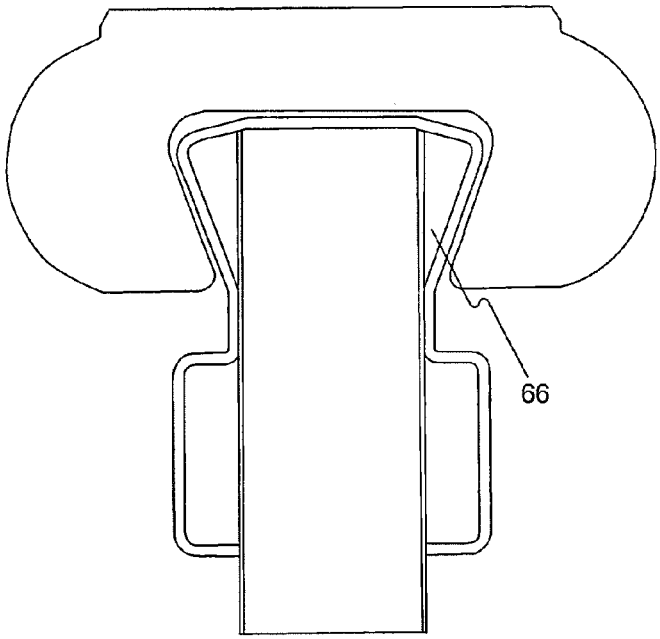
Figure 10C:
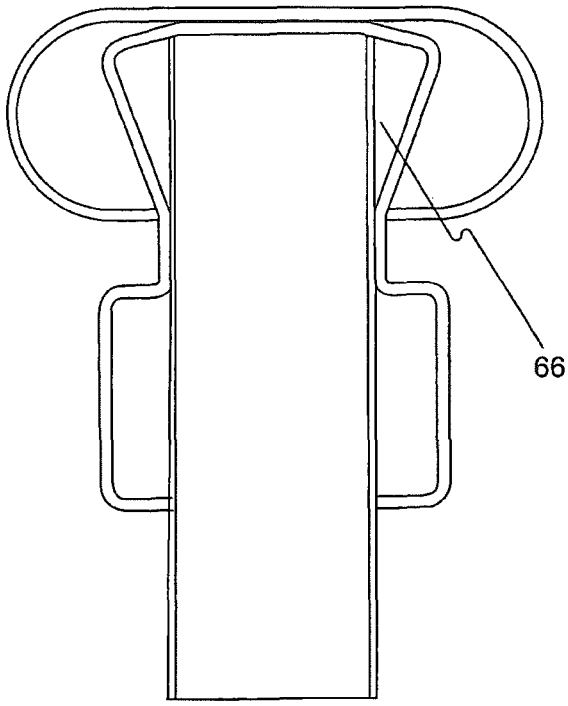
Figure 10D:
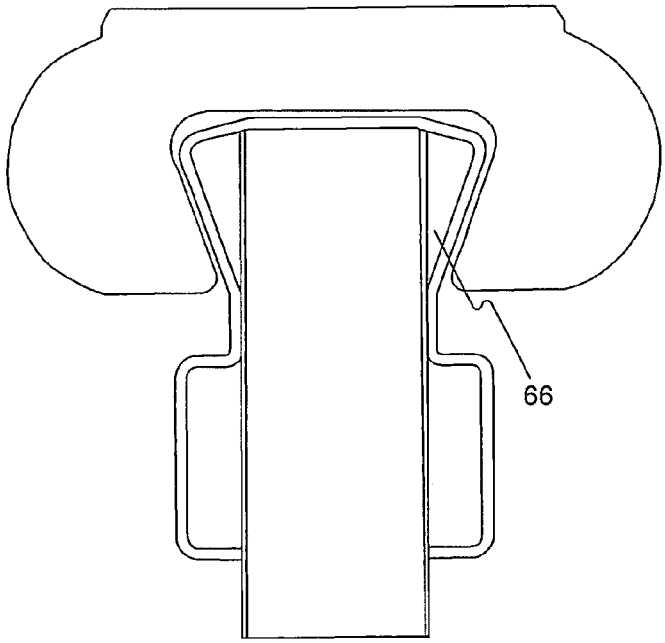
Figure 10E:
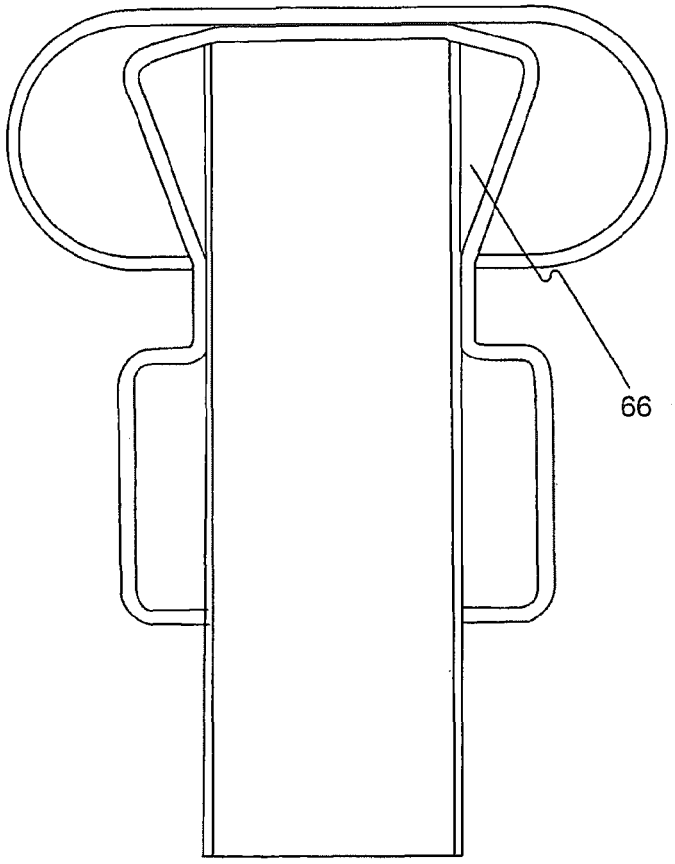
Figure 10F:
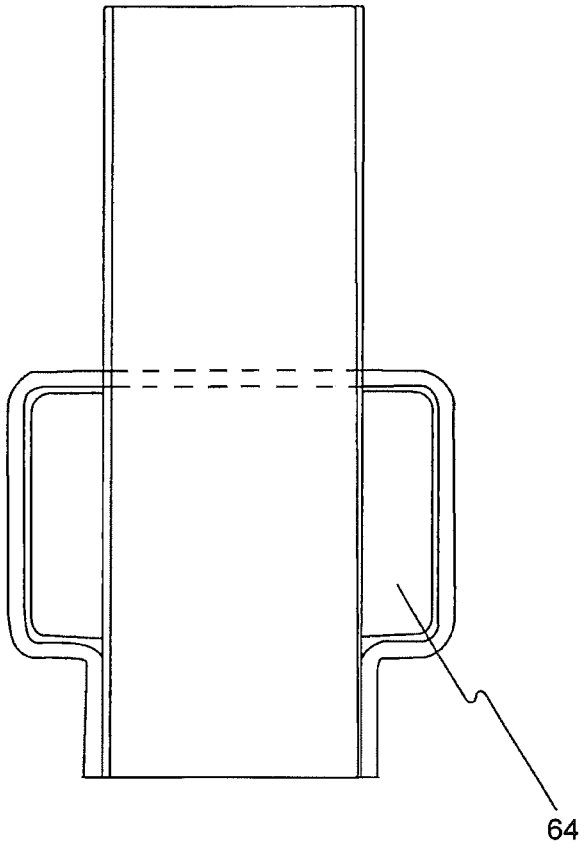
FIG. 10*f* is perspective view of the lower horizontal rail of the fence systems of FIG. 9 with an accent rail.

Accent rails, as shown in FIGS. 10*a*-10*f* can be attached to the lower and upper horizontal rails 64, 66. FIGS. 10*a*-*f* illustrate various options for accent rails for the upper horizontal rail 66, including no accent rail (FIG. 10*a*), white vinyl (FIG. 10*b*), steel powder coated (FIG. 10*c*), shaped PT wood (FIG. 10*d*), shaped composite (FIG. 10*e*), and as well as a nylon accent for the lower horizontal rail 64 (FIG. 10*f*).

The process of assembling the fence system 68 is designed to be simple and to result in aesthetically pleasing connections. The process for assembling the fence system preferably will be performed in the following sequence of steps, but the invention is not limited to this sequence.

In the preferred embodiment, the fence system 68 can be assembled by attaching the inner structural post 2 to a substantially horizontal surface, for example a deck. This step is repeated as necessary until the desired final fence configuration is achieved, by using each fence post 1 as an end, corner, or straight run fence section. Referring to FIG. 3 the inner structural vertical post 2 is inserted into the coaxial bore 3 of the lower insert block 16 with the lower insert block 16 moving over and around the inner structural vertical post 2 until it is in contact with a substantially horizontal surface or, as in the preferred embodiment, with the base flange 8.

Figure 5:
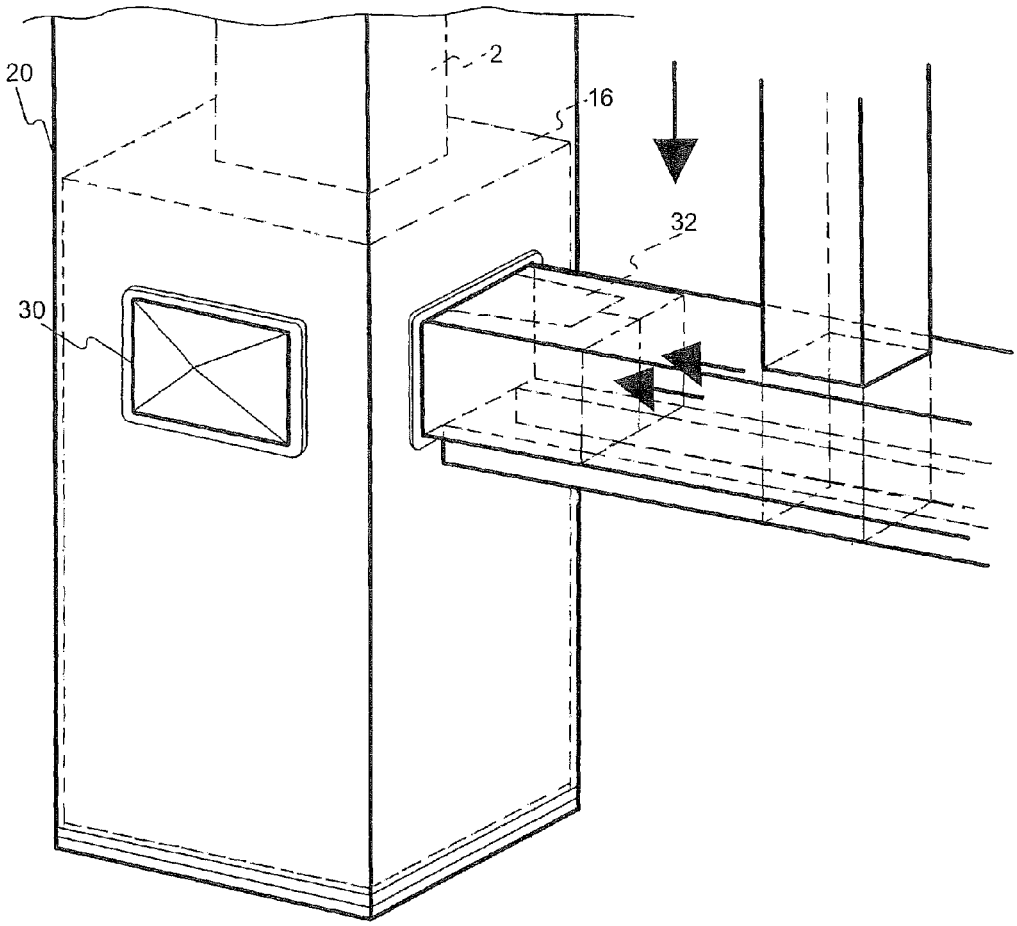
FIG. 5 is an perspective view of the exterior of the bottom of the fence post depicting installation of an upper horizontal rail support in accordance with the invention

Referring to FIGS. 4, 5 and 8*b*, the first and second horizontal rail supports 32, 34 are inserted though the lower and upper apertures 30, 28, respectively. In a preferred embodiment of this invention, the first and second horizontal rail supports are inserted from the interior 46 of the outer post 20 to the exterior 40 of the outer post 20. The outer post 20 slides over and around the inner structural vertical post 2 and the lower insert block 16, so that the inner structural vertical post 2 extends upward within the bore 26 of the outer post 20 and the lower insert block 16 applies an upward compressive force to the second portion 42 of the first horizontal rail support 32. FIG. 6 shows the upper insert block 48 inserted into the upper distal opening 24 of the outer post 20 until it contacts and applies a downward compressive force to the second portion 44 of the second horizontal rail support 34. The open ends of the lower and upper horizontal rails 64, 66 slide onto the first and second horizontal rail supports 32, 34, respectively.

Another step of the assembly process is locking the upper and lower horizontal rail supports 32, 34 in place against the upper and lower horizontal rails 66, 64. In one embodiment, this locking step comprises inserting a locking device 50, or specifically a wedge 52, between an inner wall of each of the lower and upper horizontal rails 64, 66 and an outer wall of the corresponding horizontal rail support 32, 34. This is further illustrated in FIGS. 7 and 8*a*.

Figure 11A:
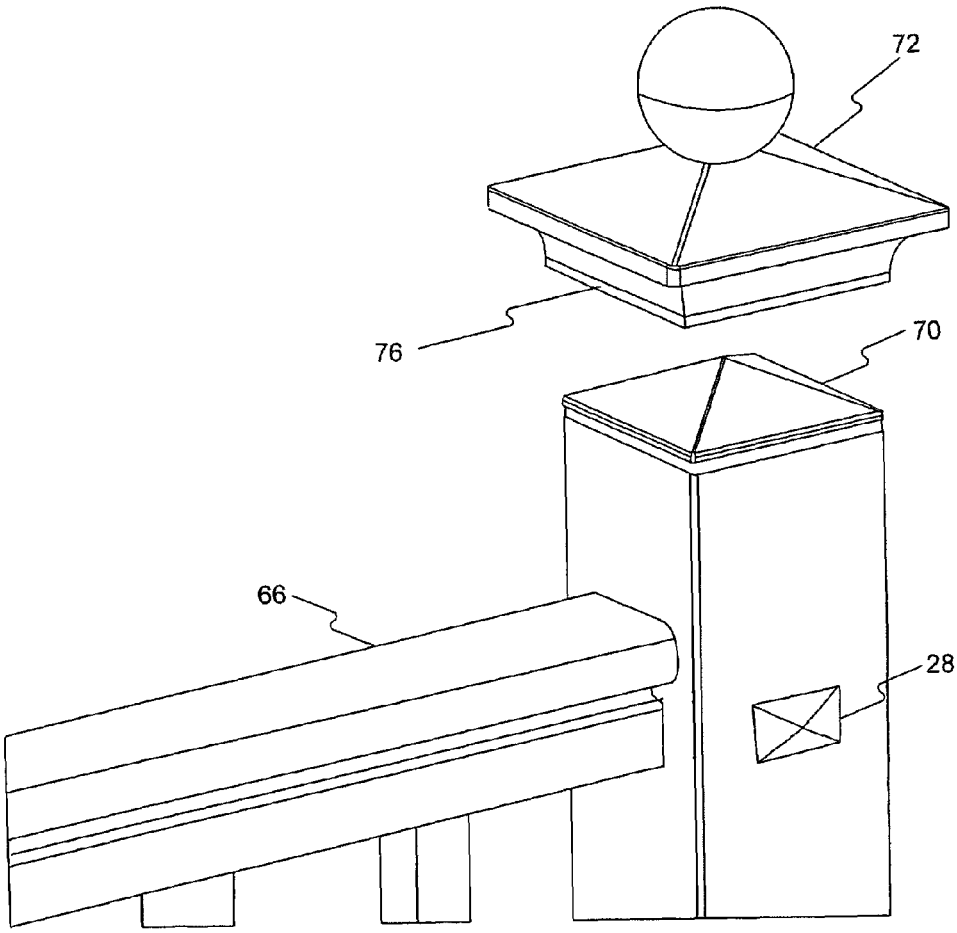
FIGS. 11*a* and 11*b* are front elevational views illustrating the fence post of FIG. 1 with various configurations of post caps.
Figure 11B:
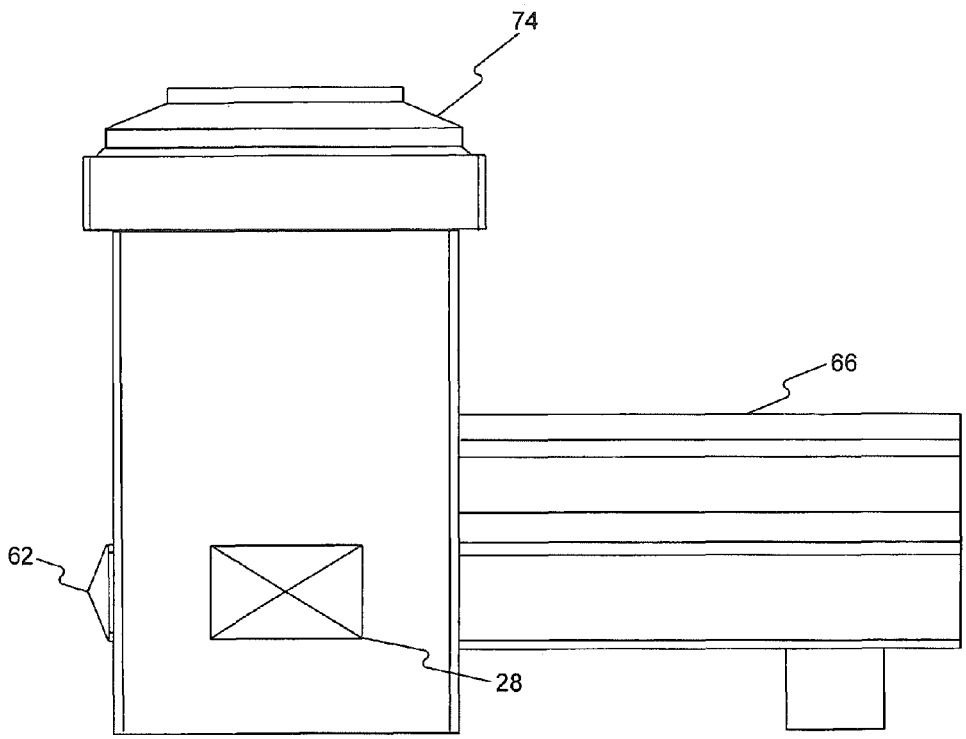

A post cap 70 can be inserted into the upper distal opening 24 of the outer post 20. As illustrated in FIGS. 11*a*-*b*, accent post caps including a pyramid with a ball 72 and a flat top 74 post caps have lower distal openings that slide over the post cap 70. The accent post caps 72, 74 are held into place with interior teeth 76.

Having thus described the fence system of the present invention, and method of assembly thereof, with particular reference to the preferred embodiments, it will be apparent to persons of ordinary skill in the art that various changes and modifications can be made therein without departing from the spirit and scope of the present invention, which is defined by the appended claims and their legal equivalents.

I claim:

1. A fence post comprising:

an inner structural vertical post, having upper and lower distal ends, the lower distal end comprising a base flange configured to be attached to a surface, the inner structural vertical post defining a vertical axis;

a lower insert block having a first height and a coaxial bore, slidable over and around the inner structural vertical post to a position in contact with the base flange;

an outer post having a coaxial bore, with upper and lower distal openings, dimensioned to insert over and around both the inner structural vertical post and the lower insert block, the outer post having an upper aperture proximate the upper distal opening, and a lower aperture positioned at a selected height above the lower distal opening, the selected height being substantially equal to the first height of the lower insert block;

an upper insert block dimensioned to insert into the upper distal opening in the outer post;

a first horizontal rail support insertable through the lower aperture in a direction substantially normal to the vertical axis, a first portion of the first horizontal rail support extending exterior of the outer post, and a second portion of the first horizontal rail support positioned in an interior of the outer post, the first horizontal rail support being held in position by an upward compressive force applied by the lower insert block to the second portion of the first horizontal rail support in the interior of the outer post; and a second horizontal rail support insertable through the upper aperture in a first direction, a first portion of the second horizontal rail support extending exterior of the outer post, and a second portion of the second horizontal rail support positioned in the interior of the outer post, the second horizontal rail support being held in place by a downward compressive force applied by the upper insert block to the second portion of the second horizontal rail support in the interior of the outer post.

2. The fence post of claim 1, wherein the second portions of the first and second horizontal rails supports comprise flanges.

3. The fence post of claim 1, further comprising upper and lower locking devices, insertable through the respective upper and lower apertures with the respective first and second horizontal rail supports, locking the first and second rail supports in place in the respective apertures.

4. The fence post of claim 3, wherein each of the upper and lower locking devices comprise a wedge configured to fit against a side of the respective horizontal rail support, having an inner sloped surface in contact with a corresponding sloped outer surface of the respective horizontal rail support.

5. The fence post of claim 4, wherein the side of the respective horizontal rail support includes a projecting tab, and the inner surface of the wedge includes a concave slot configured to receive the projecting tab.

6. The fence post of claim 1, wherein the fence post comprises multiple surfaces, with an aperture on each surface.

7. The fence post of claim 6, further comprises a decorative cap, insertable in upper and lower apertures which do not contain first and second horizontal rail supports.

8. The fence post of claim 1, further comprising a post cap, insertable in the upper distal opening of the outer post.

9. The fence post of claim 8, further comprising an accent post cap, insertable over and around the post cap.

10. A fence system comprising:

an inner structural vertical post, having upper and lower distal ends, the lower distal end comprising a base flange configured to be attached to a surface, the inner structural vertical post defining a vertical axis;

a lower insert block having a first height and a coaxial bore, slidable over and around the inner structural vertical post to a position in contact with the base flange;

an outer post having a coaxial bore, with upper and lower distal openings, dimensioned to insert over and around both the inner structural vertical post and the lower insert block, the outer post having an upper aperture proximate the upper distal opening, and a lower aperture positioned at a selected height above the lower distal opening, the selected height being substantially equal to the first height of the lower insert block;

an upper insert block dimensioned to insert into the upper distal opening in the outer post;

a first horizontal rail support insertable through the lower aperture in a direction substantially normal to the vertical axis, a first portion of the first horizontal rail support extending exterior of the outer post, and a second portion of the first horizontal rail support positioned in an interior of the outer post, the first horizontal rail support being held in position by an upward compressive force applied by the lower insert block to the second portion of the first horizontal rail support in the interior of the outer post;

a second horizontal rail support insertable through the upper aperture in a first direction, a first portion of the second horizontal rail support extending exterior of the outer post, and a second portion of the second horizontal rail support positioned in the interior of the outer post, the second horizontal rail support being held in place by a downward compressive force applied by the upper insert block to the second portion of the second horizontal rail support in the interior of the outer post; and lower and upper horizontal rails having open ends insertable in place over and around the first and second horizontal rail supports, respectively.

11. The fence system of claim 10, wherein the second portions of the first and second horizontal rail support comprise flanges.

12. The fence system of claim 10, further comprising rail support locking wedges configured to wedge into place between inner walls of the upper and lower horizontal rails, and corresponding outer surfaces of the respective horizontal rail supports, thereby locking the upper and lower rails in place.

13. The fence system of claim 12, wherein the outer surfaces of the respective horizontal rail supports include projecting tabs, and inner surfaces of the wedges include concave slots configured to receive the projecting tabs.

14. The fence system of claim 12, wherein wedging contact between the rail support wedges and the outer surfaces the rail support wedges and the outer surfaces of the horizontal rail supports hold the horizontal rails in place.

15. The fence system of claim 12, wherein the upper and lower horizontal rails each have an opening in at least one surface, configured for insertion therethrough of the respective rail support locking wedges.

16. The fence system of claim 10, further comprising accent rails, insertable over and around the upper and lower horizontal rails.

17. A method of assembling a fence, comprising the steps of:

attaching to a substantially horizontal surface an inner structural vertical post having upper and lower distal ends, the inner structure vertical post defining a vertical axis;

inserting over the inner structural vertical post a lower insert block, having a first height and a coaxial bore, with upper and lower openings, the lower insert block moving over and around the inner structural vertical post to a position in contact with the substantially horizontal surface;

providing an outer post having a coaxial bore, with upper and lower distal openings dimensioned to insert over and around both the inner structural vertical post and the lower insert block, the outer post having an upper set of apertures proximate the upper distal opening, and a lower set of apertures positioned at a selected height above the lower distal opening, the selected height being substantially equal to the first height of the lower insert block;

inserting, through the lower and upper apertures, respectively, first and second horizontal rail supports in a first direction substantially normal to the vertical axis and substantially parallel to one another, such that a first portion of each horizontal rail support extends to an exterior of the outer post, and a second portion of each horizontal rail support is positioned in an interior of the outer post;

sliding the outer post over and around the inner structure vertical post and the lower insert block, so that the inner structure vertical post extends upward within the bore of the outer post, and the lower insert block contacts, and applies an upward compressive force to the second portion of the first horizontal rail support;

inserting an upper insert block into the upper distal opening of the outer post, such that the upper insert block contacts and applies a downward compressive force to the second portion of the second horizontal rail support;

sliding open ends of upper and lower horizontal rails onto respective first and second horizontal rail supports; and locking the upper and lower horizontal rails in place against the upper and lower horizontal rail supports.

18. The method of claim 17, wherein the locking step comprises inserting a wedge between an inner wall of each of the upper and lower horizontal rails, and an outer wall of the corresponding horizontal rail support.

19. The method of claim 17, wherein the horizontal rail supports are inserted from the interior of the outer post to the exterior of the outer post.

* * * * *